US010689913B2

(12) United States Patent
Costa de Oliveira et al.

(10) Patent No.: US 10,689,913 B2
(45) Date of Patent: Jun. 23, 2020

(54) SUPPORTING A STRING WITHIN A WELLBORE WITH A SMART STABILIZER

(71) Applicant: Saudi Arabian Oil Company, Dhahran (SA)

(72) Inventors: Victor Carlos Costa de Oliveira, Dhahran (SA); Mario Augusto Rivas Martinez, Dhahran (SA); Khaled K. Abouelnaaj, Dhahran (SA); Bader S. Al-Zahrani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 85 days.

(21) Appl. No.: 15/927,683

(22) Filed: Mar. 21, 2018

(65) Prior Publication Data

US 2019/0292897 A1 Sep. 26, 2019

(51) Int. Cl.
*E21B 10/32* (2006.01)
*E21B 10/30* (2006.01)
(Continued)

(52) U.S. Cl.
CPC ..... *E21B 10/32* (2013.01); *E21B 10/30* (2013.01); *E21B 10/322* (2013.01);
(Continued)

(58) Field of Classification Search
CPC ..... E21B 44/04; E21B 7/28; E21B 10/345; E21B 17/1021; E21B 47/08; E21B 10/34;
(Continued)

(56) References Cited

U.S. PATENT DOCUMENTS 1,812,044 A 6/1931 Grant
2,169,502 A * 8/1939 Santiago ..... E21B 10/345 175/268
(Continued)

FOREIGN PATENT DOCUMENTS

CN 204177988 2/2015
EP 377234 10/1989
(Continued)

OTHER PUBLICATIONS

International Search Report and Written Opinion issued in International Application No. PCT/US2019/022736 dated May 31, 2019, 16 pages.
(Continued)

*Primary Examiner* — Michael R Wills, III
(74) *Attorney, Agent, or Firm* — Fish & Richardson P.C.

(57) ABSTRACT

A retractable and extendable roller reamer is positioned on a string. The retractable and extendable roller reamer is configured to support and centralize the string within the wellbore. An extension and retraction mechanism is configured to extend and retract the roller reamer. A hydraulic power unit is configured to control the extension and retraction mechanism. Sensors positioned on or within the roller reamer. The sensors are configured to detect parameters of the well-string stabilizing system. A controller is operatively coupled to the hydraulic power unit and the plurality of sensors. The controller is configured to be positioned in a wellbore. The controller is configured to receive signals from the sensors. The signals represent the parameters detected by the sensors. The controller is configured to identify the parameters represented by the signals. The controller is configured to adjust a well-string stabilizing operation in response to the received signals.

27 Claims, 9 Drawing Sheets

(51) Int. Cl.
*E21B 44/00* (2006.01)
*E21B 17/10* (2006.01)
*E21B 10/34* (2006.01)

(52) U.S. Cl.
CPC ..... *E21B 10/345* (2013.01); *E21B 17/10* (2013.01); *E21B 44/00* (2013.01)

(58) Field of Classification Search
CPC ..... E21B 10/32; E21B 10/322; E21B 10/30; E21B 44/00
See application file for complete search history.

(56) References Cited

U.S. PATENT DOCUMENTS 2,499,916 A * 3/1950 Harris ..... E21B 10/30 175/267
3,335,801 A 8/1967 Wilsey
3,425,500 A 2/1969 Fuchs
3,483,934 A 12/1969 Fuchs
3,557,875 A 1/1971 Solum et al.
4,058,163 A 11/1977 Yandell
4,384,625 A 5/1983 Roper et al.
4,399,873 A 8/1983 Lindsey, Jr.
4,458,761 A 7/1984 Van Vreeswyk
4,482,014 A 11/1984 Allwin et al.
4,646,842 A 3/1987 Arnold et al.
4,674,569 A 6/1987 Revils et al.
4,681,159 A 7/1987 Allwin et al.
4,693,328 A 9/1987 Furse et al.
4,846,290 A 7/1989 Jones
4,852,654 A 8/1989 Buckner
4,855,820 A 8/1989 Barbour
4,944,348 A 7/1990 Whiteley et al.
4,993,493 A 2/1991 Arnold
5,152,342 A 10/1992 Rankin et al.
5,390,742 A 2/1995 Dines et al.
5,947,213 A 9/1999 Angle
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,899,178 B2 5/2005 Tubel
6,938,698 B2 9/2005 Coronado
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,991,489 B2 3/2015 Redlinger et al.
9,051,792 B2 6/2015 Herberg et al.
9,091,148 B2 7/2015 Moffitt et al.
9,121,255 B2 9/2015 Themig et al.
9,133,666 B2 * 9/2015 Lee ..... E21B 10/345
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,341,027 B2 5/2016 Radford et al.
9,494,003 B1 11/2016 Carr
9,506,318 B1 11/2016 Brunet
9,546,536 B2 1/2017 Schultz et al.
2002/0148607 A1 10/2002 Pabst
2003/0001753 A1 1/2003 Cernocky et al.
2004/0060741 A1 4/2004 Shipalesky et al.
2004/0134687 A1 7/2004 Radford et al.
2004/0156264 A1 8/2004 Gardner et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0041631 A1 2/2008 Vail, III
2008/0115574 A1 5/2008 Meek
2009/0045974 A1 2/2009 Patel
2009/0050333 A1 2/2009 Smith
2009/0114448 A1 * 5/2009 Laird ..... E21B 10/34 175/61
2009/0145666 A1 6/2009 Radford et al.
2009/0223670 A1 9/2009 Snider
2009/0289808 A1 11/2009 Prammer
2010/0097205 A1 4/2010 Script
2010/0101786 A1 4/2010 Lovell et al.
2010/0139981 A1 6/2010 Meister et al.
2010/0212891 A1 8/2010 Stewart et al.
2010/0212900 A1 8/2010 Eddison et al.
2010/0212901 A1 8/2010 Buytaert
2010/0258298 A1 10/2010 Lynde et al.
2010/0282511 A1 11/2010 Maranuk et al.
2011/0031023 A1 * 2/2011 Menezes ..... E21B 7/068 175/61
2011/0067884 A1 3/2011 Burleson et al.
2011/0073329 A1 3/2011 Clemens et al.
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0048571 A1 3/2012 Radford et al.
2012/0085540 A1 4/2012 Heijnen
2012/0175135 A1 7/2012 Dyer et al.
2012/0211280 A1 * 8/2012 Dewey ..... E21B 47/08 175/57
2012/0241154 A1 9/2012 Zhou
2012/0247767 A1 10/2012 Themig et al.
2012/0307051 A1 12/2012 Welter
2012/0312560 A1 12/2012 Bahr et al.
2013/0128697 A1 5/2013 Contant
2013/0153245 A1 6/2013 Knobloch et al.
2013/0292175 A1 11/2013 Radford et al.
2014/0060844 A1 3/2014 Barbour et al.
2014/0083769 A1 3/2014 Moriarty et al.
2014/0090898 A1 4/2014 Moriarty et al.
2014/0126330 A1 5/2014 Shampine et al.
2014/0139681 A1 5/2014 Jones, Jr. et al.
2014/0166367 A1 6/2014 Campbell et al.

(56) References Cited

U.S. PATENT DOCUMENTS

| | | | | |
|---|---|---|---|---|
| 2014/0172306 | A1 | 6/2014 | Brannigan | |
| 2014/0208847 | A1 | 7/2014 | Baranov | |
| 2014/0308203 | A1 | 10/2014 | Sheinberg et al. | |
| 2015/0027706 | A1 | 1/2015 | Symms | |
| 2015/0090459 | A1 | 4/2015 | Cain et al. | |
| 2015/0101864 | A1 | 4/2015 | May | |
| 2015/0152713 | A1 | 6/2015 | Garcia et al. | |
| 2015/0176362 | A1 | 6/2015 | Prieto et al. | |
| 2015/0226009 | A1 | 8/2015 | Claudey et al. | |
| 2015/0267500 | A1 | 9/2015 | Van Dongen et al. | |
| 2015/0308203 | A1 | 10/2015 | Lewis | |
| 2016/0160578 | A1 | 6/2016 | Lee | |
| 2016/0215612 | A1 | 7/2016 | Morrow | |
| 2016/0230508 | A1 | 8/2016 | Jensen | |
| 2016/0237764 | A1 | 8/2016 | Jellison et al. | |
| 2016/0237768 | A1 | 8/2016 | Jamison et al. | |
| 2016/0356152 | A1 | 12/2016 | Croux | |
| 2017/0044834 | A1* | 2/2017 | Peters | E21B 10/322 |
| 2017/0074071 | A1 | 3/2017 | Tzallas et al. | |
| 2017/0159365 | A1* | 6/2017 | Solem | E21B 10/32 |
| 2018/0030810 | A1 | 2/2018 | Saldanha | |
| 2019/0292896 | A1* | 9/2019 | Costa de Oliveira | E21B 47/12 |

FOREIGN PATENT DOCUMENTS

| | | |
|---|---|---|
| EP | 618345 | 10/1994 |
| EP | 2692982 | 5/2014 |
| EP | 2835493 | 2/2015 |
| GB | 2157743 | 10/1985 |
| GB | 2194571 | 3/1988 |
| GB | 2261238 | 12/1993 |
| GB | 2460096 | 11/2009 |
| GB | 2470762 | 12/2010 |
| WO | 2003058545 | 7/2003 |
| WO | 2011038170 | 3/2011 |
| WO | 2011095600 | 8/2011 |
| WO | 2011159890 | 12/2011 |

OTHER PUBLICATIONS

International Search Report and Written Opinion issued in International Application No. PCT/US2019/022758 dated May 31, 2019, 15 pages.

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.pdf, 4 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

* cited by examiner

SUPPORTING A STRING WITHIN A WELLBORE WITH A SMART STABILIZER

TECHNICAL FIELD

This disclosure relates to wellbore operations.

BACKGROUND

When forming a wellbore, a hole-opener can be included with a drill string uphole of a drill bit. The hole-opener widens the wellbore during the drilling process, while the drill bit forms a pilot hole. In some instances, a separate trip can be performed with a larger drill bit to widen the wellbore. Hole-openers can be solid pieces or actuate-able devices. An actuate-able device includes members that can extend outward from a string and into the wall of the wellbore. Both solid devices and actuate-able devices can include roller cones configured to crush rock within the wellbore, polycrystalline diamond compact cutters configured to scrape layers of rock within the wellbore, or a combination of the two.

SUMMARY

This disclosure describes technologies relating to opening wellbores with smart hole-openers.

An example implementation of the subject matter described within this disclosure is a well-string stabilizing system with the following features. A retractable and extendable roller reamer is positioned on a string. The retractable and extendable roller reamer is configured to support and centralize the string within the wellbore. An extension and retraction mechanism is configured to extend and retract the roller reamer. A hydraulic power unit is configured to control the extension and retraction mechanism. Sensors positioned on or within the roller reamer. The sensors are configured to detect parameters of the well-string stabilizing system. A controller is operatively coupled to the hydraulic power unit and the plurality of sensors. The controller is configured to be positioned in a wellbore. The controller is configured to receive signals from the sensors. The signals represent the parameters detected by the sensors. The controller is configured to identify the parameters represented by the signals. The controller is configured to adjust a well-string stabilizing operation in response to the received signals.

Aspects of the example implementation, which can be combined with the example implementation alone or in combination, include the following. Adjusting a parameter of a well-string stabilizing operation includes adjusting the retractable and extendable roller reamer.

Aspects of the example implementation, which can be combined with the example implementation alone or in combination, include the following. The hydraulic power unit includes a hydraulic reservoir configured to retain hydraulic fluid. An expansion member is configured to expand when pressurized hydraulic fluid is received into the expansion member. The expansion member is configured to expand the extension and retraction mechanism. A hydraulic pump is configured to move hydraulic fluid from the hydraulic reservoir to the expansion member.

Aspects of the example implementation, which can be combined with the example implementation alone or in combination, include the following. The extension and retraction mechanism includes a wedge-shaped mandrel coupled to the expansion member. The wedge-shaped mandrel is configured to move in a longitudinal direction. A wedge-shaped member is attached to a roller of the roller reamer. The wedge-shaped member is configured to interact with the wedge-shaped mandrel. The wedge-shaped member is configured to move laterally outward from the drill string in response to movement from the mandrel. A retraction spring is configured to retract wedge-shaped member.

Aspects of the example implementation, which can be combined with the example implementation alone or in combination, include the following. Thee retractable and extendable roller reamer is configured to smooth an inner surface of the wellbore.

Aspects of the example implementation, which can be combined with the example implementation alone or in combination, include the following. A power supply is configured to provide electrical power to the controller and the hydraulic power unit.

Aspects of the example implementation, which can be combined with the example implementation alone or in combination, include the following. A drill bit is positioned downhole of the retractable and extendable roller reamer. The drill bit is configured to form a wellbore downhole of the retractable and extendable roller reamer.

Aspects of the example implementation, which can be combined with the example implementation alone or in combination, include the following. The retractable and extendable roller reamer includes three rollers.

Aspects of the example implementation, which can be combined with the example implementation alone or in combination, include the following. The hydraulic power unit is a first hydraulic power unit. The system includes a second hydraulic power unit and a third hydraulic power unit. Each hydraulic power unit is operatively coupled to the three rollers. Each hydraulic power unit is configured to retract or extend at least one of the three rollers.

Aspects of the example implementation, which can be combined with the example implementation alone or in combination, include the following. Any one hydraulic power unit can control any one of the three rollers.

Aspects of the example implementation, which can be combined with the example implementation alone or in combination, include the following. The controller is attached to the roller reamer and is positioned uphole of the roller reamer.

Aspects of the example implementation, which can be combined with the example implementation alone or in combination, include the following. The controller includes one or more processors and a computer-readable medium storing instructions executable by the one or more processors to perform operations. The operations include receiving, from a topside facility outside of the wellbore, instructions to perform operations within the wellbore. The operations include transmitting at least a portion of the instructions to the controller. The retractable and extendable roller reamer smooths a wall of the wellbore in response to the instructions. The operations include receiving a status signal representing a status of the retractable and extendable roller-type reamer from at least one of the sensors. The operations include transmitting, to the topside facility, the status signal.

Aspects of the example implementation, which can be combined with the example implementation alone or in combination, include the following. The status signal includes a state of the wellbore-type hole opening system. The state includes either an engaged or a disengaged state. An engaged state includes the roller reamer being in an extended position. An extended position includes extending from a cylindrical body of the well-string stabilizing system to a wall of the wellbore. A disengaged state includes the rollers not extending from the cylindrical body to the wall of the wellbore.

Aspects of the example implementation, which can be combined with the example implementation alone or in combination, include the following. The status signal includes a torque experienced by the roller reamer, a rotational speed of the roller reamer, or a radius of a wellbore.

Aspects of the example implementation, which can be combined with the example implementation alone or in combination, include the following. One or more transmitters are located at the topside facility. The one or more transmitters are configured to transmit the instructions to the one or more processors. One or more receivers are at the topside facility. The one or more receivers are configured to receive a status signal from the one or more processors.

Aspects of the example implementation, which can be combined with the example implementation alone or in combination, include the following. The one or more transmitters and the one or more receivers are configured to communicate wirelessly with the one or more processors.

Aspects of the example implementation, which can be combined with the example implementation alone or in combination, include the following. The hydraulic power unit includes a hydraulic pump fluidically connected to the system. The hydraulic pump is configured to supply hydraulic fluid at a pressure sufficient to extend and retract the roller reamer.

An example implementation of the subject matter described within this disclosure is a method with the following features. Instructions to perform hole opening operations within the wellbore are received by a controller deployed within a wellbore from a topside facility located outside of the wellbore. At least a portion of the instructions are transmitted, by the controller, to a hydraulic power unit. A retractable and extendable roller reamer is activated, by the hydraulic power unit, to smooth a wall of a wellbore. A set of parameters of the hydraulic power unit and the retractable and extendable cone-type reamer are detected by sensors. A status of the retractable and extendable cone-type reamer is determined in response to receiving signals from the plurality of sensors. The cone-type reamer is adjusted in response to determining the status.

Aspects of the example method, which can be combined with the example method alone or in combination, include the following. Activating the retractable and extendable roller reamer includes pumping a hydraulic fluid from a hydraulic reservoir into an expansion member. The expansion member is expanded with the pumped hydraulic fluid. A wedge-shaped mandrel is longitudinally displaced in response to expanding the expansion member. A wedge-shaped member is laterally displaced to extend a roller of the roller reamer towards a wall of the wellbore.

Aspects of the example method, which can be combined with the example method alone or in combination, include the following. A status signal that includes the determined status from the controller is transmitted, by the controller, to the topside facility.

Aspects of the example method, which can be combined with the example method alone or in combination, include the following. The hydraulic power unit includes a hydraulic pump. Activating, by the hydraulic power unit, the retractable and extendable roller reamer to smooth a wall of the wellbore, includes pumping, by the hydraulic pump, hydraulic fluid to mechanically activate the roller reamer. Activating the roller reamer includes extending the roller reamer out radially from a central body.

An example implementation of the subject matter described within this disclosure is a well string stabilizer with the following features. A retractable and extendable roller reamer is configured to support a string within a wellbore. An extension and retraction actuator is configured to extend and retract the roller reamer. A hydraulic power unit is configured to control the extension and retraction actuator. Sensors are configured to detect parameters of the roller reamer. A controller is operatively coupled the hydraulic power unit and the sensors. The controller is configured to control the hydraulic power unit. The controller is configured to be positioned in a wellbore. The controller is configured to receive signals from the sensors. The signals represent the parameters detected by the sensors. The controller is configured to identify the parameters represented by the signals. The controller is configured to adjust the stabilizer in response to the received signals. A power supply is configured to provide electrical power to the controller and the hydraulic power unit. The power supply is configured to be positioned downhole.

Aspects of the example well string stabilizer, which can be combined with the example well string stabilizer alone or in part, include the following. The hydraulic power unit includes a hydraulic reservoir configured to retain hydraulic fluid. An expansion member is configured to expand when pressurized hydraulic fluid is received into the expansion member. The expansion member is configured to expand the extension and retraction mechanism. A hydraulic pump is configured to move hydraulic fluid from the hydraulic reservoir to the expansion member.

Aspects of the example well string stabilizer, which can be combined with the example well string stabilizer alone or in part, include the following. The extension and retraction mechanism includes a wedge-shaped mandrel coupled to the expansion member. The wedge-shaped mandrel is configured to move in a longitudinal direction. A wedge-shaped member is attached to a roller of the roller reamer. The wedge-shaped member is configured to interact with the wedge-shaped mandrel. The wedge-shaped member is configured to move laterally outward from a string in response to movement from the mandrel. A retraction spring is configured to retract wedge-shaped member.

Aspects of the example well string stabilizer, which can be combined with the example well string stabilizer alone or in part, include the following. The power supply includes a lithium-ion battery.

Aspects of the example well string stabilizer, which can be combined with the example well string stabilizer alone or in part, include the following. The sensors include a gauge sensor configured to determine a radius of the wellbore, a torque sensor configured to measure a torque imparted on the retractable and extendable tri-cone type reamer by a drill string, or an RPM sensor configured to determine a rotational speed of the retractable and extendable tri-cone type reamer.

Aspects of the example well string stabilizer, which can be combined with the example well string stabilizer alone or in part, include the following. The controller is configured to transmit analog signals from the plurality of sensors to a topside facility.

The details of one or more implementations of the subject matter described in this disclosure are set forth in the accompanying drawings and description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
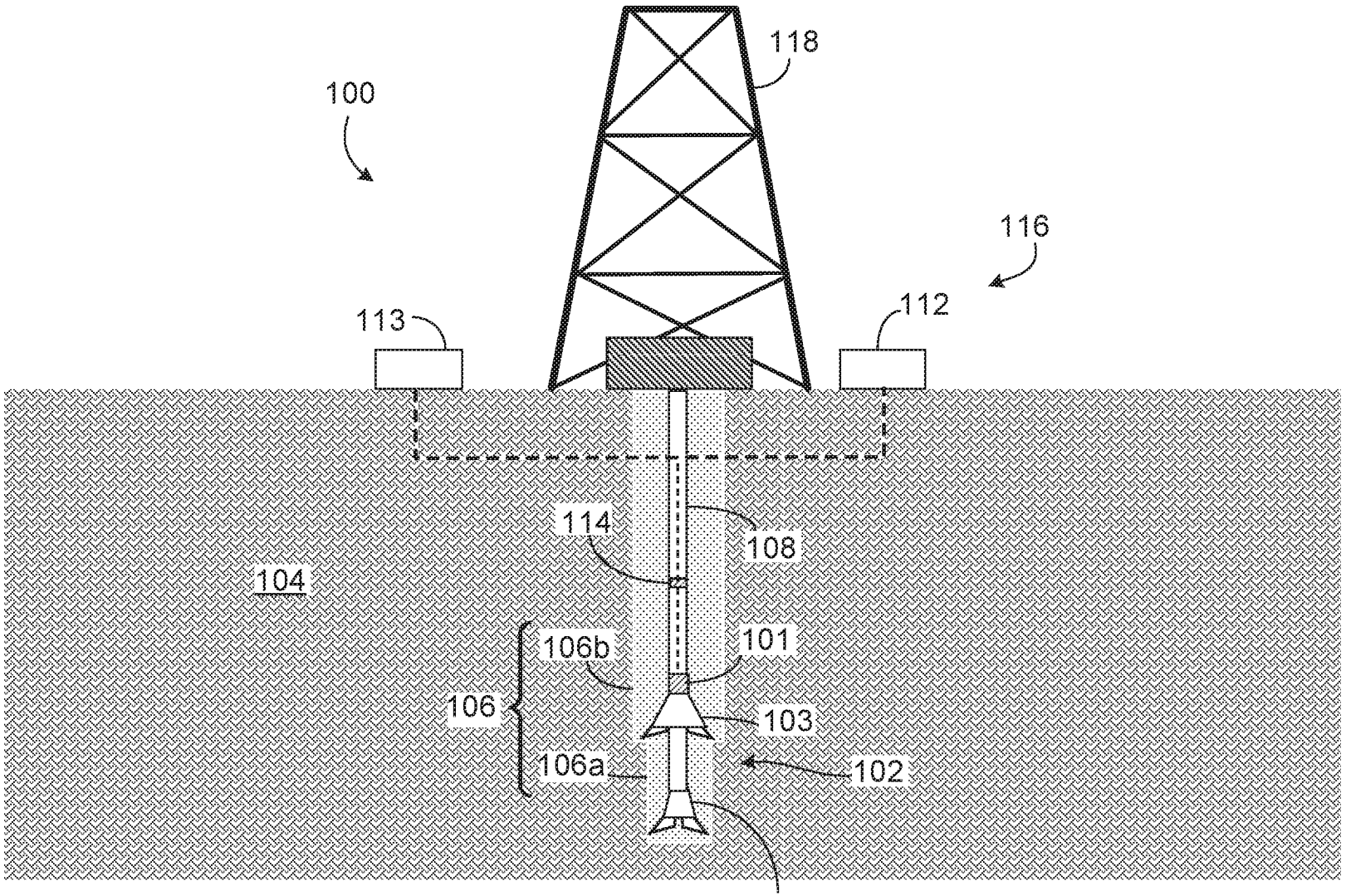
FIGS. 1A-1C are side cross-sectional views of an example wellbore system.

When opening (increasing the radius of) a wellbore, hole-openers often have a fixed radius. In some instances, only a section of the wellbore needs to be widened, sections must be widened different amounts, or both. In such instances, having an actuate-able hole-opener can be beneficial. Having such a hole-opener on a drill string would allow opening operations to take place simultaneously with drilling, saving both time and money. Additional advantages include a resulting better hole quality as a single trip is used to widen/enlarge the hole. If an additional trip were used, the time it takes for the additional trip could be detrimental to the formation. For example, hole collapse, tight hole, or washouts can be experienced in that time, all of which will decrease the quality of the well construction. For example, such complications can result in poor cement quality when cementing casing to the formation.

This disclosure relates to a roller cone hole-opener with retractable cones. The hole-opener system includes several sensors, a controller, and communication electronics to communicate and determine a state of the hole-opener. The hole-opener includes three separate hydraulic power units; each hydraulic power unit controls one or more of the retractable cones. Each cone can be controlled independently. The hole-opener is capable of monitoring several parameters, including borehole size, cone seal status, torque, RPM, weight on bit, and other useful information in real time. The real-time information can be communicated to a topside facility in real-time or by downloading the information once the hole-opener is returned to the topside facility. In instances where information is communicated to a topside facility in real-time, the information is relatively recent, for example, several microseconds old.

As a length of the drill string increases, frictional forces against rotation increase, especially in horizontal or deviated wells. Such issues occur when the string is no longer centered within the wellbore, and the string scrapes against the wellbore walls. In addition, the walls of the wellbore can include non-uniformities after the wellbore is formed.

This disclosure relates to a string stabilizer that includes a roller reamer with retractable rollers. The roller reamer can support the functions of supporting, centering, and stabilizing the string, as well as smoothing out the wellbore walls to reduce any non-uniform sections. The string stabilizing system includes several sensors, a controller, and communication electronics to communicate and determine a state of the stabilizer. The stabilizer includes three separate hydraulic power units; each hydraulic power unit controls one or more of the retractable rollers. Each roller can be controlled independently. The stabilizer is capable of monitoring several parameters, including borehole size, torque, RPM, and other useful information in real time. The real-time information can be communicated to a topside facility in real-time or by downloading the information once the stabilizer is returned to the topside facility.

FIG. 1A shows an example cross-sectional view of a wellbore-type hole-opening system 100. As illustrated in FIG. 1A, a derrick 118 that can support a drill string 108 within a wellbore 106 that has been or is being formed in a geologic formation 104, is included. A bottom hole assembly 102 is positioned at the downhole end of the string 108 and can include a controller 101, a hole-opener 103, and a drill bit 105. The controller 101 can be mounted on and carried by the bottom hole assembly 102 and can monitor the hole-opening system 100. While the controller 101 is shown to be uphole of the hole-opener 103, the controller 101 can be positioned anywhere within the assembly 102. The assembly 102 can also include a drill bit 105 positioned downhole of the hole-opener 103. The hole-opener 103 is explained in greater detail later in the disclosure.

At a topside facility 116, a transmitter 113 and a receiver 112 can be positioned to communicate with the controller 101. The system 100 can also include one or more repeaters 114 that can be positioned between the topside facility 116 and the bottom hole assembly 102 within the wellbore 106. The one or more repeaters 114 can boost a strength of a wireless radio signal between the controller 101 and the topside facility 116.

The wellbore 106 can have multiple sections. For example, as illustrated, the wellbore includes a first section 106*a* and a second section 106*b*. The first section 106*a* is formed by the drill bit 105 and has a first radius. The drill bit 105 can include a tri-cone drill bit, a polycrystalline diamond compact (PDC) drill bit, or any other type of drill bit. The second section 106*b* has been widened by the hole-opener 103 and has a second radius that is greater than the radius of the first section. While the wellbore 106 is shown as a vertical wellbore, aspects of this disclosure can also be applied to horizontal wellbores, deviated wellbores, or combinations of them.

In operation, the controller 101 sends and receives signals to the topside facility 116. The signals can include statuses of the system 100, commands executable by the system 100, or other signals. When a command signal is received, the controller 101 activates, opens, or expands the hole-opener 103. The hole-opener 103 can widen the wellbore 106 to form the expanded section 106*b*. During operation, the controller 101 can detect parameters with various sensors within the hole-opener 103. The controller 101 can perform a function based on the received parameters, or send the parameters to the topside facility 116. Further details on the various system 100 components are explained in greater detail later within this disclosure.

Figure 1B:
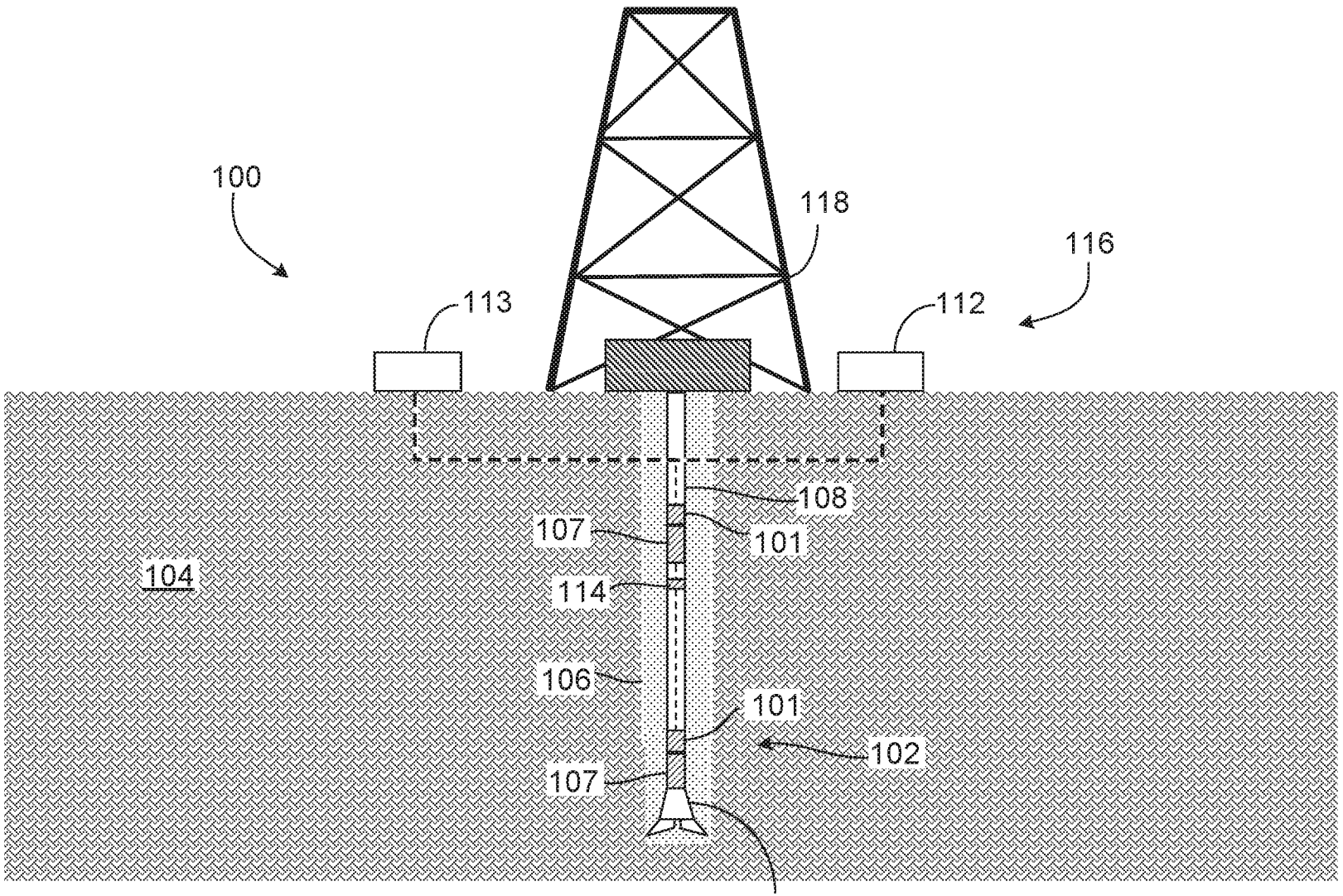
Figure 1C:
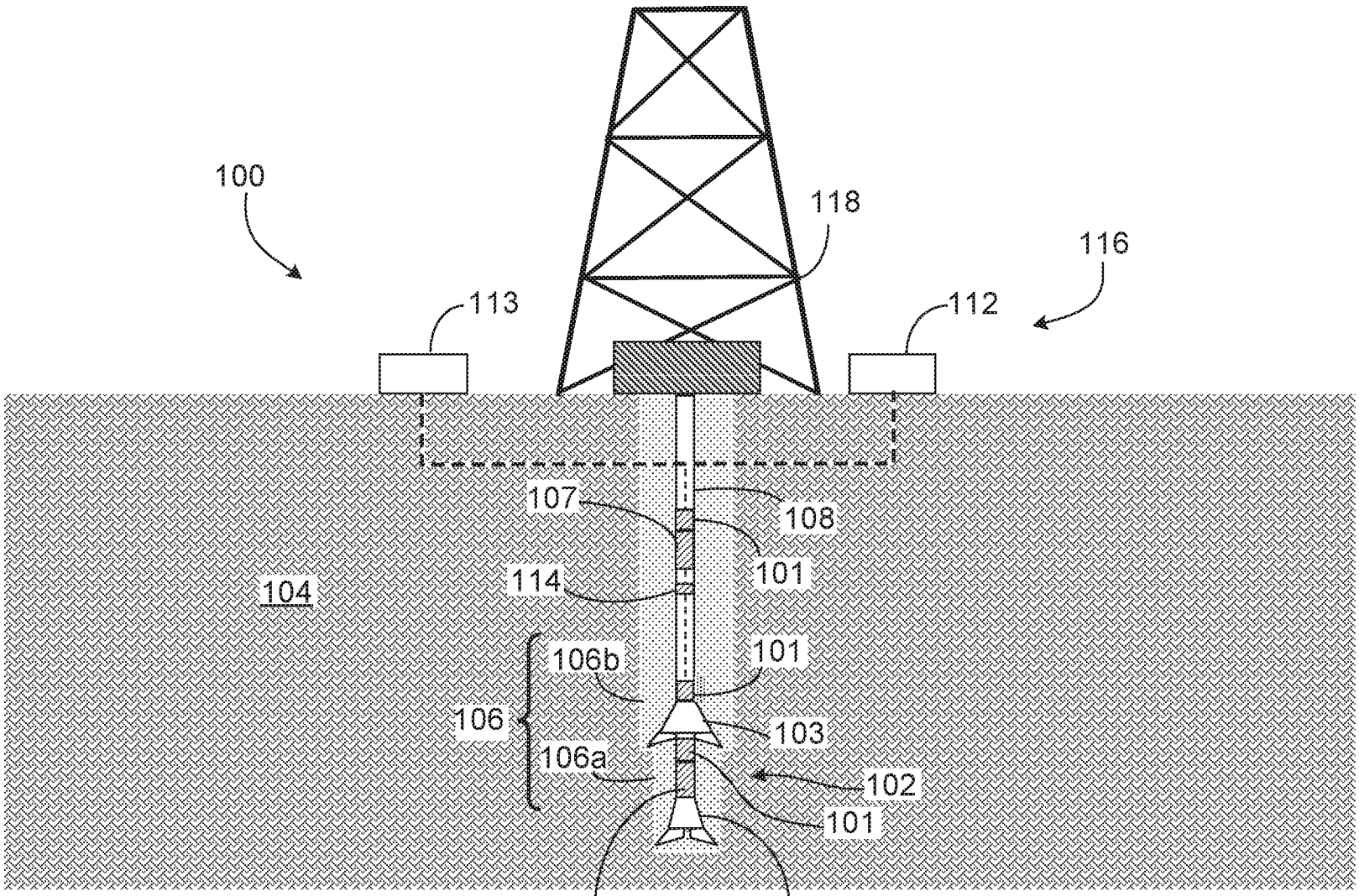

In FIG. 1B, the system 100 includes one or more stabilizers 107, each with its own controller 101. The stabilizer 107 can be used to stabilize the string 108, centralize the string 108, reduce rotational friction of the string 108, or any combination. In some instances, the stabilizer 107 can be used to smooth the walls of the wellbore 106. In FIG. 1C, the stabilizer can be included on the same string as the hole-opener 103. In such an implementation, the stabilizer 107 can be positioned uphole or downhole of the hole-opener 103. The stabilizer 107 is explained in greater detail later in this disclosure.

Figure 2A:
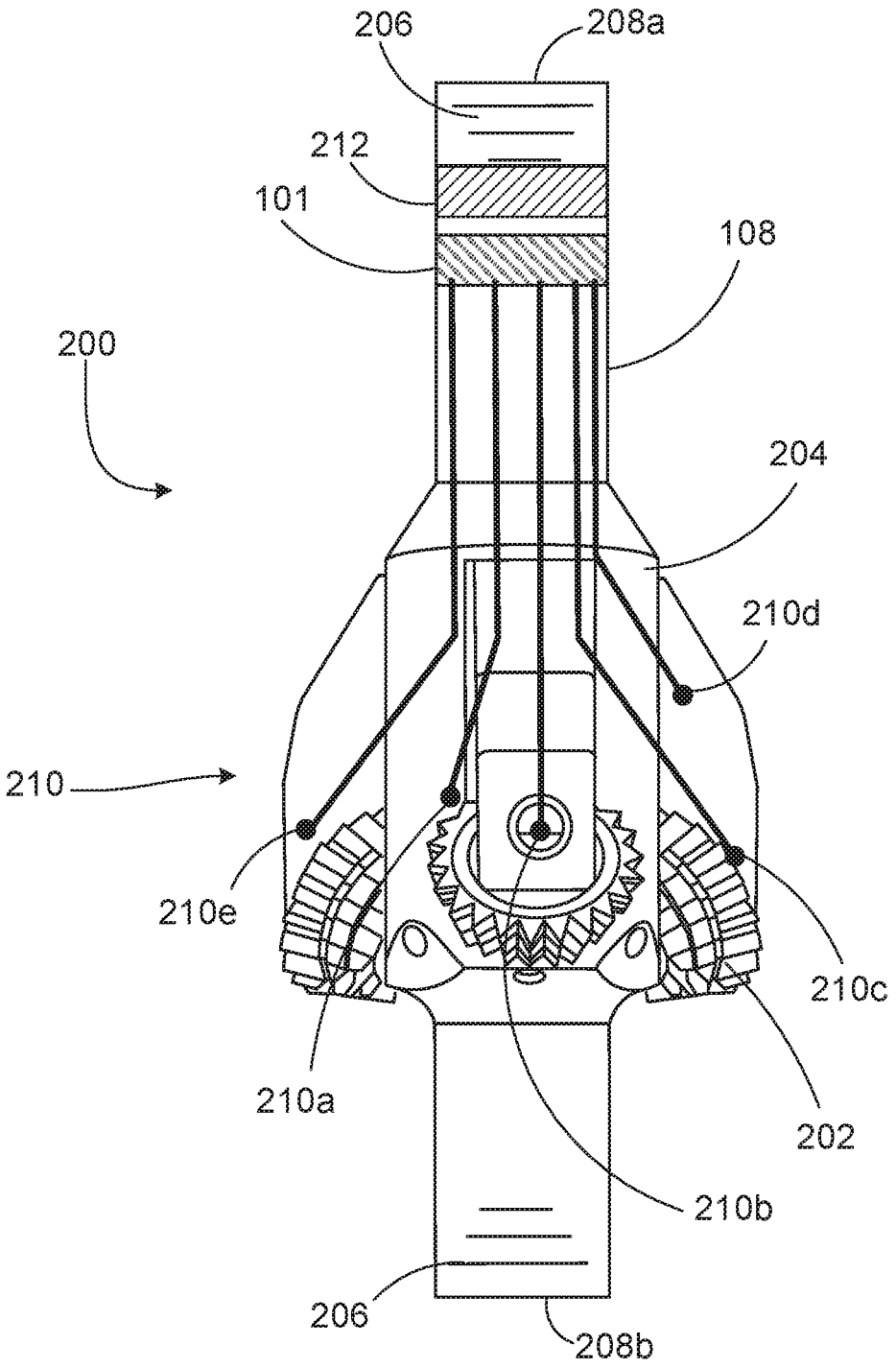
FIG. 2A is a side view of an example hole-opener.

FIG. 2A is a schematic diagram of a retractable and extendable cone-type reamer 200 that can be used as the hole-opener 103. As illustrated, the retractable and extendable cone-type reamer 200 is positioned on a drill string 108 and includes three cones 202 that are configured to increase a radius of a section of the wellbore 106 that is on the same radial plane as the cones. While the extendable cone-type reamer 200 is illustrated with three cones 202, any number of cones 202, such as four cones 202, can be used without departing from this disclosure. The cones 202 are capable of being retracted into the tool when not in use, or being extended when in use. The gauge (amount of extension) can be adjusted during operations. Details on the actuator are described in greater detail in FIGS. 4A-4B. Each of the three cones 202 can be individually actuated. That is, each of the individual cones 202 can be extended from the central body 204 or retracted within the central body 204. The reamer 200 can connect to the drill string 108 with threaded connections 206 at both an uphole end 208*a* and a downhole end 208*b*.

The extendable cone-type reamer 200 includes one or more sensors 210 positioned on or within the cone-type reamer 200. The sensors 210 are configured to detect parameters of the wellbore-type hole-opening system 100. For example, in some implementations, the cone-type reamer 200 can include a gauge sensor 210*a* that is configured to determine a radius of the wellbore. Such a task is accomplished by measuring an extension length of each of the three cones 202. The extension of each of the cones 202 can be controlled by the controller 101. That is, the controller can adjust a hydraulic pressure of a hydraulic power unit (described later) to maintain a specified gauge. In some implementations, the extension length of each cone 202 can be determined by determining a hydraulic pressure within a hydraulic power unit described later. A wear sensor 210*b* can be included and is configured to measure a wear rate of the cones 202. As the hole is opened, there will be frictional wear on the cones 202 and tool gauge. The wear sensor 210*b* measures the amount of wear. The controller 101 is configured to give a warning when the wear reaches a maximum specified limit. A torque sensor 210*c* can be included and is configured to measure a torque imparted on the retractable and extendable tri-cone type reamer 200 by the drill string 108. In some implementations, the torque sensor 210*c* can include a strain gauge. A weight-on-bit sensor 210*d* can be included and is configured to measure an axial load on the tri-cone type reamer 200 imparted by the drill string 108. In some implementations, the weight-on-bit sensor 210*d* can include a strain gauge or load cell. The weight-on-bit of the cones 202 can be similar to that of the drill bit 105 depending on the distance between the cones 202 and the drill bit 105. An RPM sensor 210*e* can be included and is configured to determine a rotational speed of the retractable and extendable tri-cone type reamer. In some implementations, the RPM sensor 210*e* can include a dynamometer or an optical sensor. The RPM sensor 210*e* can be useful in the event that there is a mud motor used between the top drive at the topside facility 116 and the bottom hole assembly 102 (FIGS. 1A-1C).

Analog or digital signals from the sensors 210 feed into the controller 101. The controller 101 receives the signals from the sensors. Each signal represents a parameter of the tri-cone type reamer 200. The controller 101 is configured to adjust the tri-cone type reamer 200 in response to the received signals. The controller 101 is capable of changing drilling parameters if high torque is observed. For example, the controller 101 can send a signal to expand or retract the hole opener 103 if necessary. The controller can also maintain a fixed hole size as per the drilling program. As illustrated, the controller is uphole of the tri-cone type reamer 200, but the controller can be located anywhere in proximity to the tri-cone type reamer 200, for example, within the same string 108. The controller 101 is described in more detail in FIG. 3.

The tri-cone type reamer 200 includes a power supply 212 that is configured to provide electrical power to the controller 101 and the tri-cone type reamer 200. In some implementations, the power supply 212 includes a lithium-ion battery. In some implementations, the power supply can include a downhole generator, a super capacitor, another type of battery, rectification/conditioning circuitry, or any combination.

Figure 2B:
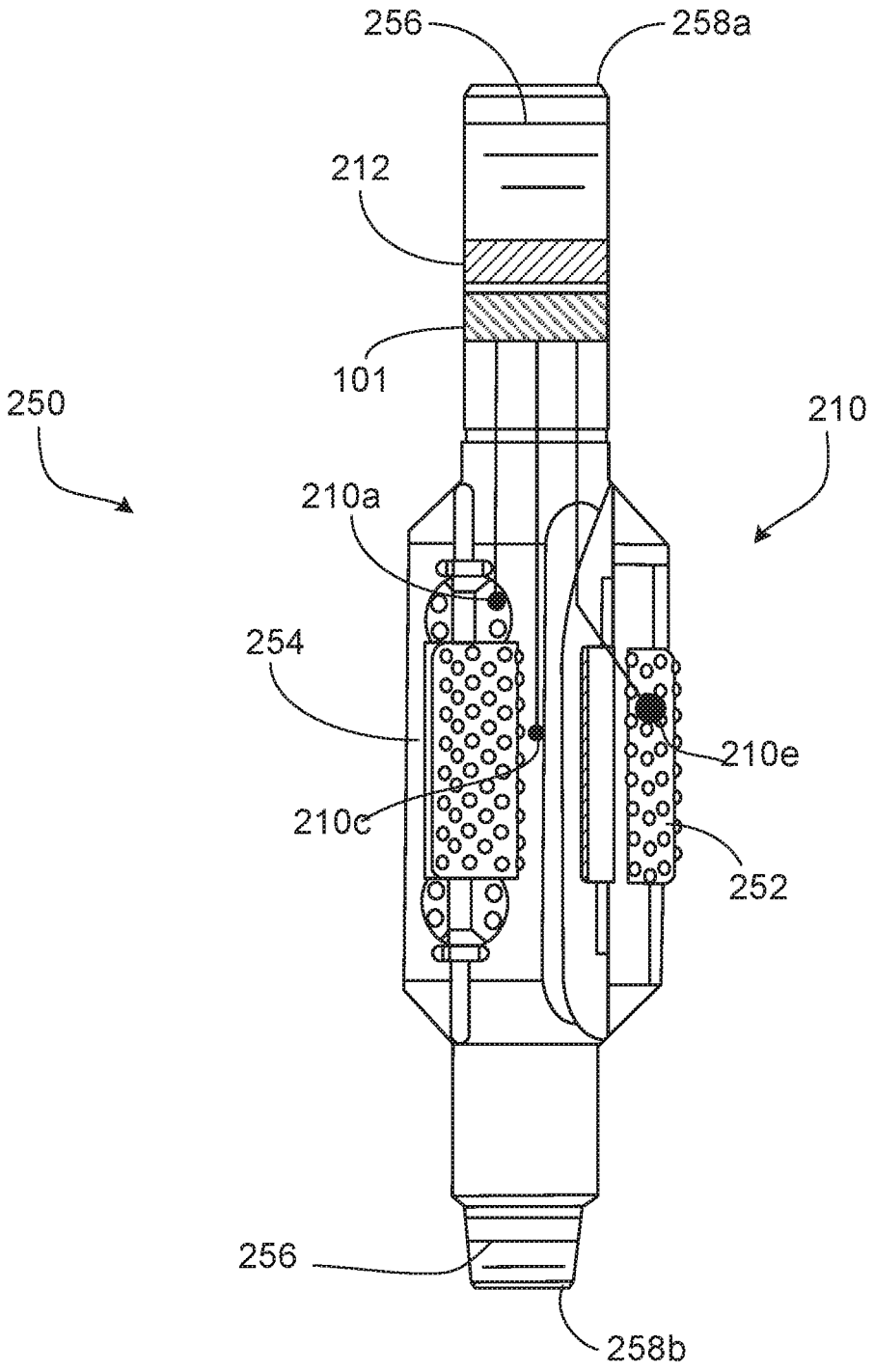
FIG. 2B is a side view of an example roller reamer.

FIG. 2B is a schematic diagram of a retractable and extendable roller reamer 250 that can be used as the stabilizer 107. As illustrated, the retractable and extendable roller reamer 250 is positioned on a drill string 108 and includes three rollers 252 that are configured to press against a section of the wellbore 106 that is on the same radial plane as the rollers. While the table and extendable roller reamer 250 is illustrated with three rollers 252, any number of rollers 252, such as four rollers 252, can be used without departing from this disclosure. The rollers 252 are capable of being retracted into the tool when not in use, or being extended when in use. A specific gauge can be set or adjusted during operation. Details on the actuator are described in greater detail in FIGS. 4A-4B. Both the roller reamer and the tri-cone type reamer can use a similar actuator. Each of the three rollers 252 can be individually actuated. That is, each of the individual rollers 252 can be extended from the central body 254 or retracted within the central body 254. The reamer 250 can connect to the drill string 108 with threaded connections 256 at both an uphole end 258*a* and a downhole end 258*b*.

The extendable roller-type reamer 250 includes one or more sensors 210 positioned on or within the roller-type reamer 250. The sensors 210 are configured to detect parameters of the wellbore-type hole-opening system 100. For example, in some implementations, the roller-type reamer 250 can include a gauge sensor 210*a* that is configured to determine a radius of the wellbore. Such a task is accomplished by measuring an extension length of each of the three rollers 252. The extension of each of the rollers 252 can be controlled by the controller 101. That is, the controller can adjust a hydraulic pressure of a hydraulic power unit (described later) to maintain a specified gauge. In some implementations, the extension length of each roller 252 can be determined by determining a hydraulic pressure within a hydraulic power unit described later. A torque sensor 210*c* can be included and is configured to measure a torque imparted on the retractable and extendable tri-roller type reamer 250 by the drill string 108. In some implementations, the torque sensor can include a strain gauge. An RPM sensor 210*e* can be included and is configured to determine a rotational speed of the retractable and extendable tri-roller type reamer 250. In some implementations, the RPM sensor 210*e* can include a dynamometer or an optical sensor. The RPM sensor 210*e* can be useful in the event that there is a mud motor used between the top drive at the topside facility 116 and the bottom hole assembly 102 (FIGS. 1A-1C). In some implementations, additional sensors, such as those described within the tri-cone type reamer 200, can be included with the roller-type reamer 250.

Analog or digital signals from the sensors 210 feed into the controller 101. The controller 101 receives the signals from the sensors. Each signal represents a parameter of the tri-roller type reamer 250. The controller 101 is configured to adjust the tri-roller type reamer 250 in response to the received signals. The controller 101 is capable of changing drilling parameters if high torque is observed. For example, the controller 101 can send a signal to expand or retract the stabilizer 107 if necessary. The controller can also maintain a fixed hole size as per the drilling program. As illustrated, the controller is uphole of the tri-roller type reamer 250, but the controller can be located anywhere in proximity to the measure of a vertical load on the tri-roller type reamer 250, for example, within the same string 108. The controller 101 is described in more detail in FIG. 3. Each hole-opener 103 and each stabilizer 107 can have separate controllers 101.

The tri-roller type reamer 250 includes a power supply 212 that is configured to provide electrical power to the controller 101 and the tri-roller type reamer 250. In some implementations, the power supply 212 includes a lithium-ion battery. In some implementations, the power supply can include a downhole generator, a super capacitor, another type of battery, rectification/conditioning circuitry, or any combination.

Figure 3:
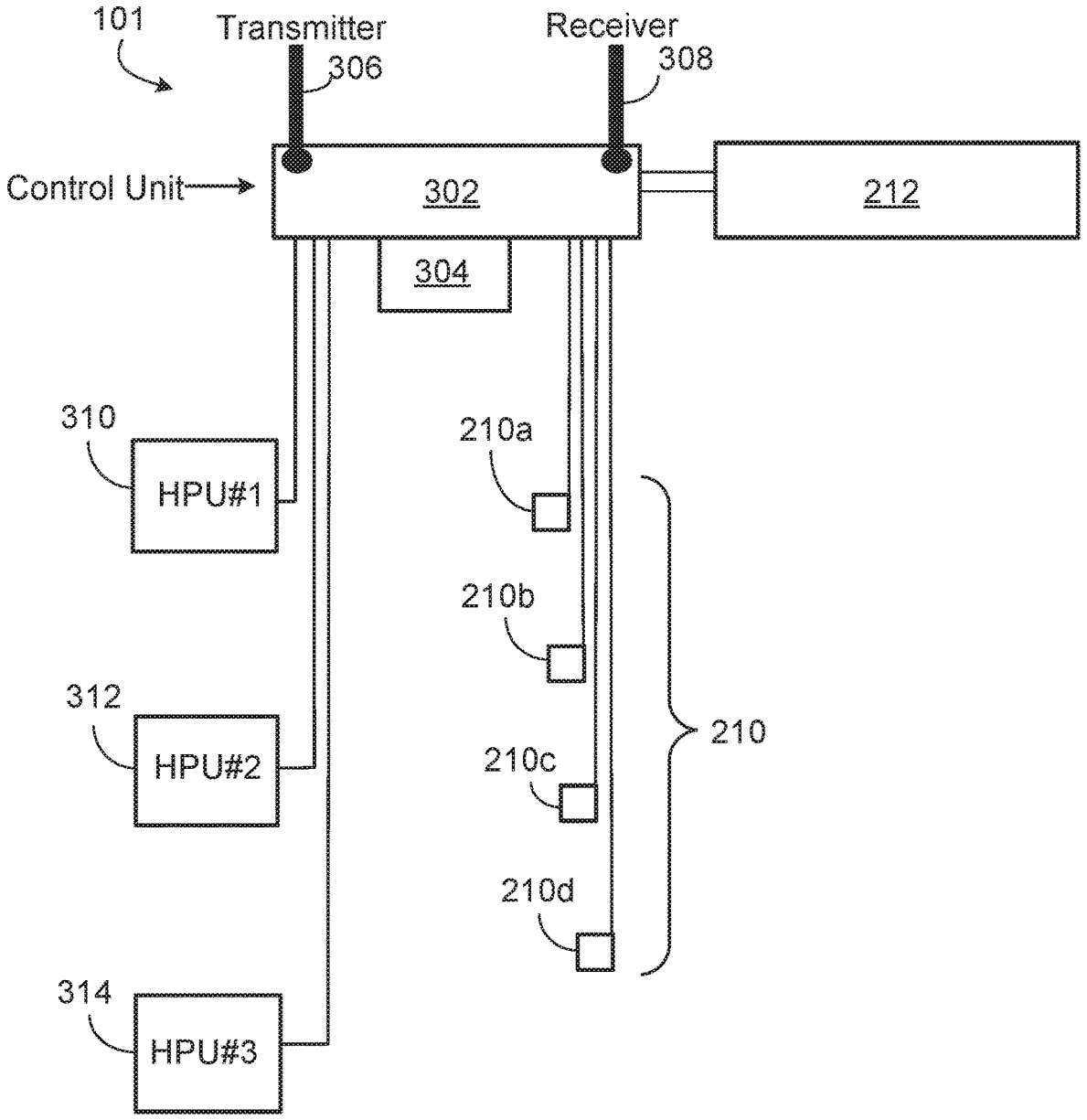
FIG. 3 shows a block diagram of an example control system.

FIG. 3 shows a block diagram of the controller 101. The controller 101 can be retained in a robust housing suited for a downhole environment. Such housing can provide isolation for the controller 101 from the downhole environment to ensure that the controller 101 is not exposed to a degrading environment. The controller 101 can also be mounted within the housing to reduce shock loads on the electronics. The controller 101 can include one or more processors 302 and a computer-readable medium 304 that stores instructions executable by the one or more processors 302 to perform operations. The one or more processors 302 are also coupled to the sensors 210. The one or more processors 302 can determine a set of parameters based on the signals received from the sensors 210. In some implementations, the controller 101 can expand or retract tools automatically based on such parameters. The controller 101 can also include a transmitter 306 and a receiver 308 that can be used to receive, from the topside facility 116, instructions to perform hole opening operations within the wellbore, and transmit, to the hole-opener 103, at least a portion of the instructions. The transmitter 306 and receiver 308 can also be used to receive, from the topside facility 116, instructions to perform stabilizing operations within the wellbore, and transmit, to the stabilizer 107, at least a portion of the instructions. In operation, the transmitter 306 and receiver 308 are operatively coupled to the transmitter 113 and the receiver 112 located at the topside facility 116 (FIGS. 1A-1C).

The transmitter 306 can also transmit the status signals to the topside facility 116. The status signals can be transmitted in real-time, that is, an operator at the topside facility 116 (FIGS. 1A-1C) can see parameters within the wellbore while operating the system 100 with minimal delays on the order of microseconds. Various sample rates can be configured in the controller 101 to suite a user's desired preferences. Signals can be sent, received, and processed in either digital or analog form. Analog and digital control loops can be configured into the controller 101 to suit the needs of the end user. The status signals can include a state of hole-opener 103 (such as an "on" state or an "off" state), a hydraulic pressure of the hole-opener 103, or any other statuses. In some implementations, the status can include a state of the hole-opener 103, for example either an engaged or a disengaged state. In such an implementation, an engaged state includes the cone-type reamer 200 or the roller reamer 250 being in an extended position, that is, the cones 202 or rollers 252 extending from the central body (204 or 254) to a wall of the wellbore 106 (FIGS. 1A-2B). In such an instance, a disengaged state includes the cones 202 or rollers 252 to not extend from the central body (204 or 254). In some instances, the status signal includes a wear state of the cone-type reamer 200, a torque experienced by the cone-type reamer 200 or roller reamer 250, a rotational speed of the cone-type reamer 200 or roller reamer 250, a weight on bit experienced by the reamer 200, or a radius of a wellbore 106. In some implementations, the controller 101 is configured to transmit analog signals from the sensors 210 to the topside facility 116. In some implementations, the roller reamer 250 can include a wear sensor similar to the tri-cone reamer 200.

The controller 101 is coupled to the power supply 212 that can be positioned within the wellbore 106. The power supply 212 can be operatively coupled to the one or more processors 302 and can provide operating power to the one or more processors 302. In some implementations, the power source can be a stand-alone power source positioned within the wellbore 106, such as a lithium-ion battery (or other rechargeable power source). In some implementations, the power supply 212 can include a downhole generator, a super capacitor, or another type of battery, such as a lead-acid battery. In an instance where a generator is used, the generator includes rectification and conditioning circuitry to provide clean power to one or more processors 302.

The system 100 can include one or more hydraulic power units, such as a first hydraulic power unit 310, a second hydraulic power unit 312, or a third hydraulic power unit 314, operatively coupled to the one or more processors 302. Any of the hydraulic power units can receive at least a portion of a set of instructions from the one or more processors 302. The hydraulic power units may receive instructions to change states ("on" command or "off" command) of a hydraulic pump, set a target pressure for the hydraulic pump, or any other command that can be executed by the hydraulic power unit. In some implementations, the different hydraulic power units may be interconnected to allow fluidic communication between each hydraulic power unit. The interconnection can allow a hydraulic power unit to control multiple cones 202 or rollers 252 in the event of a hydraulic power unit failure. In some implementations, each hydraulic power unit can include its own one or more sensors, for example, a pressure sensor or other sensor. Each hydraulic power unit can receive measurements (or other information) sensed by its one or more sensors, and transmit the same to the controller 101. While the illustrated implementations show three hydraulic power units, one for each cone 202 or roller 252, a different number of hydraulic power units can be used without departing from this disclosure. For example, a single hydraulic power unit can be used for multiple cones 202 or multiple rollers 252.

Figure 4B:
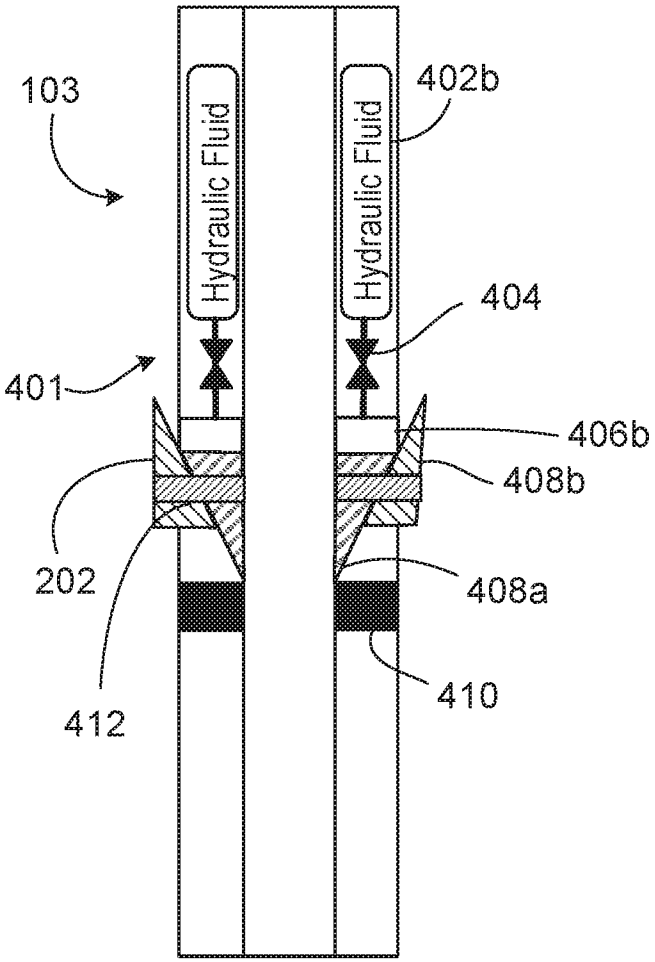
FIGS. 4A-4B show side cross-sectional views of an example actuator (engaged and disengaged).
Figure 4A:
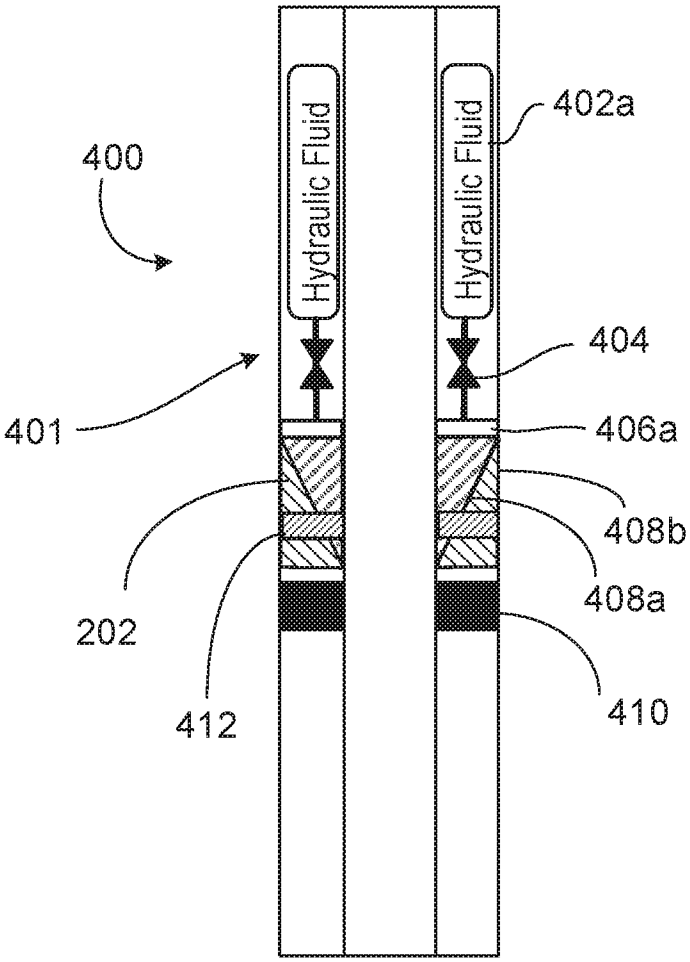

FIGS. 4A-4B show side cross-sectional views of an un-extended actuator 400 and an extended actuator 400, respectively. The actuator 400 can be used for the hole-opener 103, the stabilizer 107, or both. The actuator 400 includes a hydraulic power unit 401 operatively coupled to the controller 101. Once the hydraulic power unit 401 has received a signal to activate the hole-opener 103, the hydraulic pump 404 moves hydraulic fluid from a full hydraulic reservoir **402*a* to an unexpanded expansion member 406*a*. In some implementations, the unexpanded expansion member 406*a* can include a piston or elastomer bladder. The unexpanded expansion member 406*a* begins to expand and become expanded expansion member 406*b* as it is filled with hydraulic fluid. Similarly, the full hydraulic reservoir 402*a* becomes the depleted hydraulic reservoir 402*b* during the activation of the hole-opener 103, or the stabilizer 107. That is, activating at least one of the cones 202 or rollers 252 includes pumping hydraulic fluid to mechanically activate the respective cone 202 or roller 252 with the hydraulic pump 404. The expanded expansion member 406*b* moves a wedged-shaped mandrel 408*a* towards a wedge-shaped member 408***b*. The wedge-shaped mandrel 408*a* displaces the second wedge-shaped member 408*b* that is attached to the cones 202 or the rollers 252. This displacement causes the cones 202 or rollers 252 to extend radially outward from the hole-opener 103 and towards the wall of the wellbore 106. In some implementations, the wedge-shaped mandrel 408*a* can include multiple segments connected to multiple hydraulic power units and multiple cones 202 or rollers 252. In such an implementation, each cone 202 can be separately actuated. Once hole-opening operations are completed, the controller 101 can send a signal to the hydraulic pump 404 to pump hydraulic fluid from the expanded expansion member 406*b* back into the depleted hydraulic reservoir 402*b*. In some implementations, a separate relief valve can direct the hydraulic fluid from the expanded expansion member 406*b* back into the depleted hydraulic reservoir 402*b*. The hole-opener 103, the stabilizer 107, or both, can include a retraction device 412, such as a spring, to return the wedge-shaped mandrel 408*a* and cones 202 or rollers 252 back into the retracted position once the hydraulic fluid has been removed from the expanded expansion member 406*b*. In some implementations, the hydraulic power unit 401 may be fluidically connected to a separate hydraulic power unit in another part of the hole-opener 103 or stabilizer 107. Such a connection allows for a single hydraulic power unit to control multiple components within the hole-opener 103 or stabilizer 107 in the event of a failure of one of the hydraulic power units, such as hydraulic power unit 401.

The hydraulic power unit 401 can act as one of the hydraulic power units previously described, such as the first hydraulic power unit 310. The hydraulic power unit 401 can receive at least a portion of the sealing instructions from the controller 101. Portions of the sealing or stabilizing instructions can include changing states of the hydraulic pump, changing an output pressure of the hydraulic pump, changing position of the cones 202 or rollers 252, or any other command that can be executed by the hydraulic power unit. The cones 202 or rollers 252 can be operatively coupled to the hydraulic power unit 401, that is, the hydraulic power unit 401 can mechanically activate the hole-opener 103 to begin a hole opening operation within the wellbore 106 responsive to being activated by the controller 101. For example, the hydraulic power unit 401 itself can include hydraulic pump 404 fluidically connected to the cones 202 or rollers 252. The hydraulic pump 404 can supply hydraulic fluid, such as the hydraulic fluid stored in a full hydraulic reservoir 402*a*, at a pressure sufficient to activate the hole-opener 103 or stabilizer 107. To activate the hole-opener 103 or stabilizer 107, the hydraulic power unit 401 can cause the cones 202 or rollers 252 to extend radially outward from the hole-opener 103 or stabilizer 107 and towards the wall of the wellbore 106. In the case of the hole-opener 103, the extended cones 202 bite into the wellbore and can increase a radius of the wellbore 106. In the case of the stabilizer 107, the rollers 252 press against the walls of the wellbore 106. The rollers 252 smooth the walls of the wellbore 106 as the string 108 rotates. The rollers 252 also support the string 108 and reduce the rotational friction experience by the string 108. The hole-opener 103 and the stabilizer 107 can also include more sensors 410 to relay information back to the controller 101, such as hydraulic pressure or cone 202 position.

Figure 5:
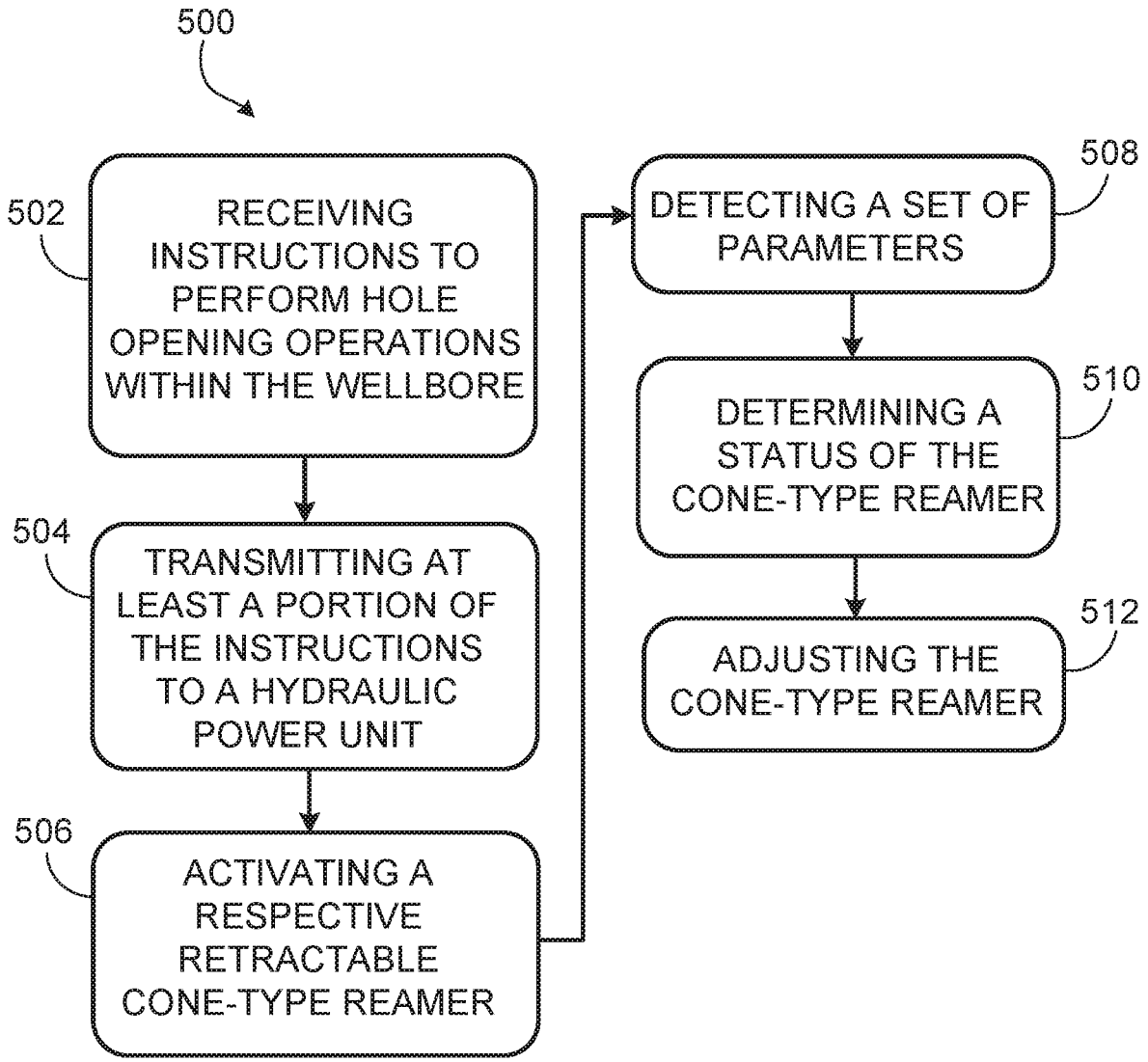
FIG. 5 is a flowchart of an example method that can be used with aspects of this disclosure.

FIG. 5 is a flowchart of an example method 500 that can be used with aspects of this disclosure. At 502, instructions to perform hole opening operations within a wellbore are received by a controller deployed within a wellbore and from a topside facility located outside of the wellbore. At 504, at least a portion of the instructions are transmitted, by the controller, to a hydraulic power unit. At 506, a retractable and extendable cone-type reamer is activated by the hydraulic power unit to increase a radius of a wellbore. At 508, a set of parameters of the hydraulic power unit and the retractable and extendable cone-type reamer are detected from sensors. At 510, a status of the retractable and extendable cone-type reamer is determined in response to receiving signals from the sensors. At 512, the cone-type reamer is adjusted in response to determining the status. A status signal with the determined status from the controller is transmitted by the controller to the topside facility.

In some implementations, the hydraulic power unit includes a hydraulic pump. Activating, by the hydraulic power unit, the retractable and extendable cone-type reamer to increase an internal radius of the wellbore, includes pumping, by the hydraulic pump, hydraulic fluid to mechanically activate the cone-type reamer. Activating the cone-type reamer includes extending the cone-type reamer out radially from a central body.

Figure 6:
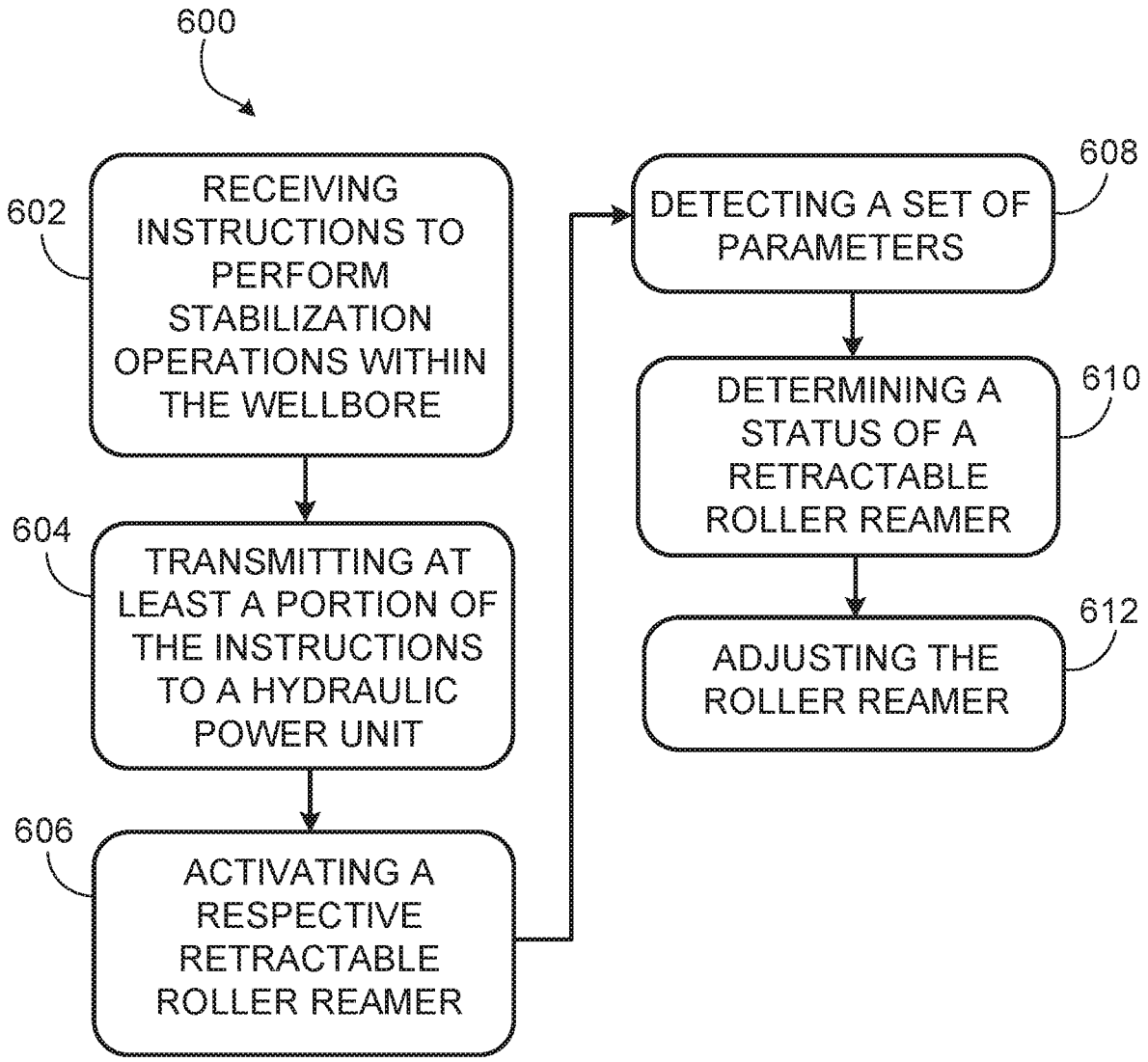
FIG. 6 is a flowchart of an example method that can be used with aspects of this disclosure.

FIG. 6 is a flowchart of an example method 600 that can be used with aspects of this disclosure. At 602, instructions to perform stabilizing operations within a wellbore are received by a controller deployed within a wellbore and from a topside facility located outside of the wellbore. At 604, at least a portion of the instructions are transmitted, by the controller, to a hydraulic power unit. At 606, a retractable and extendable roller reamer is activated by the hydraulic power unit to stabilize a string within the wellbore. At 608, a set of parameters of the hydraulic power unit and the retractable and extendable roller reamer are detected from sensors. At 610, a status of the retractable and extendable roller reamer is determined in response to receiving signals from the sensors. At 612, the roller reamer is adjusted in response to determining the status. A status signal with the determined status from the controller is transmitted by the controller to the topside facility.

In some implementations, the hydraulic power unit includes a hydraulic pump. Activating, by the hydraulic power unit, the retractable and extendable roller reamer to stabilize a string within the wellbore, includes pumping, by the hydraulic pump, hydraulic fluid to mechanically activate the roller reamer. Activating the roller reamer includes extending the roller reamer out radially from a central body.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be previously described as acting in certain combinations and even initially claimed as such, one or more features from a claimed combination can in some cases be excised from the combination, and the claimed combination may be directed to a subcombination or variation of a sub combination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described program components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A well-string stabilizing system comprising:

a retractable and extendable roller reamer positioned on a string and comprising three rollers, the retractable and extendable roller reamer configured to support and centralize the string within a wellbore;

an extension and retraction mechanism configured to extend and retract the roller reamer;

a hydraulic power unit configured to control the extension and retraction mechanism and independently control the extension and retraction of the three rollers of the retractable and extendable roller reamer;

a plurality of sensors positioned on or within the roller reamer, the plurality of sensors configured to detect parameters of the well-string stabilizing system; and a controller operatively coupled to the hydraulic power unit and the plurality of sensors, the controller configured to be positioned in a wellbore, the controller configured to:

receive a plurality of signals from the plurality of sensors, the plurality of signals representing the parameters detected by the plurality of sensors, identify the parameters represented by the plurality of signals, and adjust a well-string stabilizing operation in response to the received plurality of signals.

2. The well-string stabilizing system of claim 1, wherein adjusting a parameter of a well-string stabilizing operation comprises adjusting the retractable and extendable roller reamer.

3. The well-string stabilizing system of claim 1, wherein the hydraulic power unit comprises:

a hydraulic reservoir configured to retain hydraulic fluid;

an expansion member configured to expand when pressurized hydraulic fluid is received into the expansion member, the expansion member configured to expand the extension and retraction mechanism; and a hydraulic pump configured to move hydraulic fluid from the hydraulic reservoir to the expansion member.

4. The well-string stabilizing system of claim 3, wherein the extension and retraction mechanism comprises:

a wedge-shaped mandrel coupled to the expansion member, the wedge-shaped mandrel configured to move in a longitudinal direction;

a wedge-shaped member attached to a roller of the roller reamer, the wedge-shaped member configured to interact with the wedge-shaped mandrel, the wedge-shaped member configured to move laterally outward from the string in response to movement from the mandrel; and a retraction spring configured to retract wedge-shaped member.

5. The well-string stabilizing system of claim 1, wherein the retractable and extendable roller reamer is configured to smooth an inner surface of the wellbore.

6. The well-string stabilizing system of claim 1, further comprising a power supply configured to provide electrical power to the controller and the hydraulic power unit.

7. The well-string stabilizing system of claim 1, further comprising a drill bit positioned downhole of the retractable and extendable roller reamer, the drill bit configured to form a wellbore downhole of the retractable and extendable roller reamer.

8. The well-string stabilizing system of claim 1, wherein the hydraulic power unit is a first hydraulic power unit, wherein the system comprises a second hydraulic power unit and a third hydraulic power unit, wherein each hydraulic power unit is operatively coupled to the three rollers, each hydraulic power unit configured to retract or extend at least one of the three rollers.

9. The well-string stabilizing system of claim 1, wherein any one hydraulic power unit can control any one of the three rollers.

10. The well-string stabilizing system of claim 1, wherein the controller is attached to the roller reamer and is positioned uphole of the roller reamer.

11. The well-string stabilizing system of claim 1, wherein the controller comprises:

one or more processors; and a computer-readable medium storing instructions executable by the one or more processors to perform operations comprising:

receiving, from a topside facility outside of the wellbore, instructions to perform operations within the wellbore;

transmitting at least a portion of instructions to the controller, the retractable and extendable roller reamer smoothing a wall of the wellbore in response to the instructions;

receiving a status signal representing a status of the retractable and extendable roller-type reamer from at least one of the plurality of sensors; and transmitting, to the topside facility, the status signal.

12. The well-string stabilizing system of claim 11, wherein the status signal comprises a state of the well-string stabilizing system, the state comprising either an engaged or a disengaged state, wherein an engaged state comprises the roller reamer being in an extended position, an extended position comprising extending from a cylindrical body of the well-string stabilizing system to a wall of the wellbore, and wherein a disengaged state comprises the rollers to not extend from the cylindrical body to the wall of the wellbore.

13. The well-string stabilizing system of claim 11, wherein the status signal comprises a torque experienced by the roller reamer, a rotational speed of the roller reamer, or a radius of a wellbore.

14. The well-string stabilizing system of claim 11, further comprising:

one or more transmitters at the topside facility, the one or more transmitters configured to transmit the instructions to the one or more processors; and one or more receivers at the topside facility, the one or more receivers configured to receive a status signal from the one or more processors.

15. The well-string stabilizing system of claim 14, wherein the one or more transmitters and the one or more receivers are configured to communicate wirelessly with the one or more processors.

16. The well-string stabilizing system of claim 11, wherein the plurality of sensors comprises a first sensor connected to a first roller of the three rollers, a second sensor connected to a second roller of the three rollers, and a third sensor connected to a third roller of the three rollers, and the status signal comprises a torque experienced by one or more of the first roller, second roller, or third roller, or a rotational speed of one or more of the first roller, second roller, or third roller.

17. The well-string stabilizing system of claim 1, wherein the hydraulic power unit comprises a hydraulic pump fluidically connected to the system, the hydraulic pump configured to supply hydraulic fluid at a pressure sufficient to extend and retract the roller reamer.

18. A method comprising:

receiving, by a controller deployed within a wellbore and from a topside facility located outside of the wellbore, instructions to perform hole opening operations within the wellbore;

transmitting, by the controller, at least a portion of the instructions to a hydraulic power unit;

activating, by the hydraulic power unit, a retractable and extendable roller reamer to smooth a wall of a wellbore, the retractable and extendible roller reamer comprising a first roller, a second roller, and a third roller;

detecting a set of parameters of the hydraulic power unit and the retractable and extendable roller reamer from a plurality of sensors, the plurality of sensors comprising a first sensor connected to the first roller, a second sensor connected to the second roller, and a third sensor connected to the third roller;

determining a status of the retractable and extendable roller reamer in response to receiving signals from the plurality of sensors including the first sensor, the second sensor, and the third sensor; and adjusting the roller reamer in response to determining the status.

19. The method of claim 18, wherein activating the retractable and extendable roller reamer comprises:

pumping a hydraulic fluid from a hydraulic reservoir into an expansion member;

expanding the expansion member with the pumped hydraulic fluid;

longitudinally displacing a wedge-shaped mandrel in response to expanding the expansion member;

and laterally displacing a wedge-shaped member to extend one or more of the first roller, second roller, or third roller of the roller reamer towards a wall of the wellbore.

20. The method of claim 18, further comprising transmitting, by the controller to the topside facility, a status signal comprising the determined status from the controller.

21. The method of claim 20, wherein the hydraulic power unit comprises a hydraulic pump, wherein activating, by the hydraulic power unit, the retractable and extendable roller reamer to smooth a wall of the wellbore, comprises pumping, by the hydraulic pump, hydraulic fluid to mechanically activate the roller reamer, wherein activating the roller reamer comprises extending the roller reamer out radially from a central body, and wherein the hydraulic power unit independently controls the extension and retraction of the first roller, second roller, and third roller.

22. A well string stabilizer comprising:

a retractable and extendable roller reamer configured to support a string within a wellbore, the retractable and extendible roller reamer comprising three rollers;

an extension and retraction actuator configured to extend and retract the roller reamer;

a hydraulic power unit configured to control the extension and retraction actuator and independently control the extension and retraction of the three rollers of the retractable and extendable roller reamer;

a plurality of sensors configured to detect parameters of the roller reamer;

a controller being operatively coupled the hydraulic power unit and the plurality of sensor, the controller configured to control the hydraulic power unit, the controller configured to be positioned in a wellbore, the controller configured to:

receive a plurality of signals from the plurality of sensors, the plurality of signals representing the parameters detected by the plurality of sensors, identify the parameters represented by the plurality of signals, and adjust the stabilizer in response to the received plurality of signals; and a power supply configured to provide electrical power to the controller and the hydraulic power unit, the power supply configured to be positioned downhole.

23. The well string stabilizer of claim 22, wherein the hydraulic power unit comprises:

a hydraulic reservoir configured to retain hydraulic fluid;

an expansion member configured to expand when pressurized hydraulic fluid is received into the expansion member, the expansion member configured to expand the extension and retraction mechanism; and a hydraulic pump configured to move hydraulic fluid from the hydraulic reservoir to the expansion member.

24. The well string stabilizer of claim 23, wherein the extension and retraction mechanism comprises:

a wedge-shaped mandrel coupled to the expansion member, the wedge-shaped mandrel configured to move in a longitudinal direction;

a wedge-shaped member attached to a roller of the roller reamer, the wedge-shaped member configured to interact with the wedge-shaped mandrel, the wedge-shaped member configured to move laterally outward from a string in response to movement from the mandrel; and a retraction spring configured to retract wedge-shaped member.

25. The well string stabilizer of claim 22, wherein the power supply comprises a lithium-ion battery.

26. The well string stabilizer of claim 22, wherein the plurality of sensors comprises a gauge sensor configured to determine a radius of the wellbore, a torque sensor configured to measure a torque imparted on the retractable and extendable roller reamer by a drill string, or an RPM sensor configured to determine a rotational speed of the retractable and extendable roller reamer.

27. The well string stabilizer of claim 22, wherein the controller is configured to transmit analog signals from the plurality of sensors to a topside facility.

* * * * *